US011260670B2

(12) United States Patent
Castle et al.

(10) Patent No.: US 11,260,670 B2
(45) Date of Patent: Mar. 1, 2022

(54) FLUID RESERVOIR IMPEDANCE SENSORS

(71) Applicant: Hewlett-Packard Development Company, L.P., Spring, TX (US)

(72) Inventors: Steven T Castle, Corvallis, OR (US); Daryl E Anderson, Corvallis, OR (US); James Michael Gardner, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,876

(22) PCT Filed: Dec. 11, 2017

(86) PCT No.: PCT/US2017/065521
§ 371 (c)(1),
(2) Date: Oct. 28, 2019

(87) PCT Pub. No.: WO2019/117847
PCT Pub. Date: Jun. 20, 2019

(65) Prior Publication Data

US 2020/0298584 A1 Sep. 24, 2020

(51) Int. Cl.
*B41J 2/195* (2006.01)
*B41J 2/175* (2006.01)
*B41J 29/393* (2006.01)

(52) U.S. Cl.
CPC ..... *B41J 2/195* (2013.01); *B41J 2/17566* (2013.01); *B41J 29/393* (2013.01); *B41J 2002/17579* (2013.01)

(58) Field of Classification Search
CPC ..... B41J 2/195; B41J 2/17566; B41J 29/393; B41J 2002/17579
See application file for complete search history.

(56) References Cited

U.S. PATENT DOCUMENTS

| | | | | |
|---|---|---|---|---|
| 6,742,881 | B2 | 6/2004 | Kotaki et al. | |
| 8,922,777 | B2 | 12/2014 | Shemer et al. | |
| 9,352,564 | B2 | 5/2016 | Brocklin et al. | |
| 9,671,722 | B2 | 6/2017 | Leynen et al. | |
| 2010/0295565 | A1* | 11/2010 | Drack ..... | G01M 3/3245 324/693 |

(Continued)

FOREIGN PATENT DOCUMENTS

| | | |
|---|---|---|
| CN | 105283760 | 1/2016 |
| CN | 105992946 | 10/2016 |

(Continued)

OTHER PUBLICATIONS

Pigment Settling and Printer Maintenance, May 16, 2013, https://www.inkjetmall.com/wordpress/maintenance/pigment-settling-and-printer-maintenance.

*Primary Examiner* — Henok D Legesse
(74) *Attorney, Agent, or Firm* — Fabian VanCott

(57) ABSTRACT

A fluid reservoir (100) includes a circuit (105) extending in the fluid reservoir to be at least partially in contact with fluid (120) inside the fluid reservoir during use, at least a first impedance sensor (110) and second impedance sensor (115) coupled to the circuit, wherein the at least first and second impedance sensors are to output impedance values indicative of a degree of particle separation in the fluid.

20 Claims, 7 Drawing Sheets

(56) References Cited

U.S. PATENT DOCUMENTS

| | | | | |
|---|---|---|---|---|
| 2013/0235113 | A1 | 9/2013 | Komatsu | |
| 2013/0278656 | A1 | 10/2013 | Govyadinov | |
| 2014/0204148 | A1 | 7/2014 | Ge | |
| 2014/0375710 | A1 | 12/2014 | Blair | |
| 2016/0082746 | A1* | 3/2016 | De Saint Romain | B41J 2/18 347/89 |
| 2016/0274498 | A1* | 9/2016 | Leynen | G03G 15/105 |
| 2019/0120678 | A1* | 4/2019 | Cumbie | G01N 27/226 |

FOREIGN PATENT DOCUMENTS

| | | | |
|---|---|---|---|
| WO | WO-2013062513 | A1 | 5/2013 |
| WO | WO-2016003403 | | 1/2016 |
| WO | WO-2016018387 | A1 | 2/2016 |
| WO | WO-2016122577 | A1 | 8/2016 |
| WO | WO-2016175853 | A1 | 11/2016 |
| WO | WO-2017184144 | A1 | 10/2017 |
| WO | WO-2018067169 | A1 | 4/2018 |

* cited by examiner

FLUID RESERVOIR IMPEDANCE SENSORS

BACKGROUND

Fluid dispensing systems include any device that can eject a fluid onto a substrate. Example fluid dispensing systems may include print cartridges, lab-on-chip devices, fluid dispensing cassettes, page-wide arrays implemented in printing devices, among others. Each of these examples may include a fluid reservoir fluidically coupled to, for example, a die wherein the die ejects the fluid from the die and/or moves the fluid within the die.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
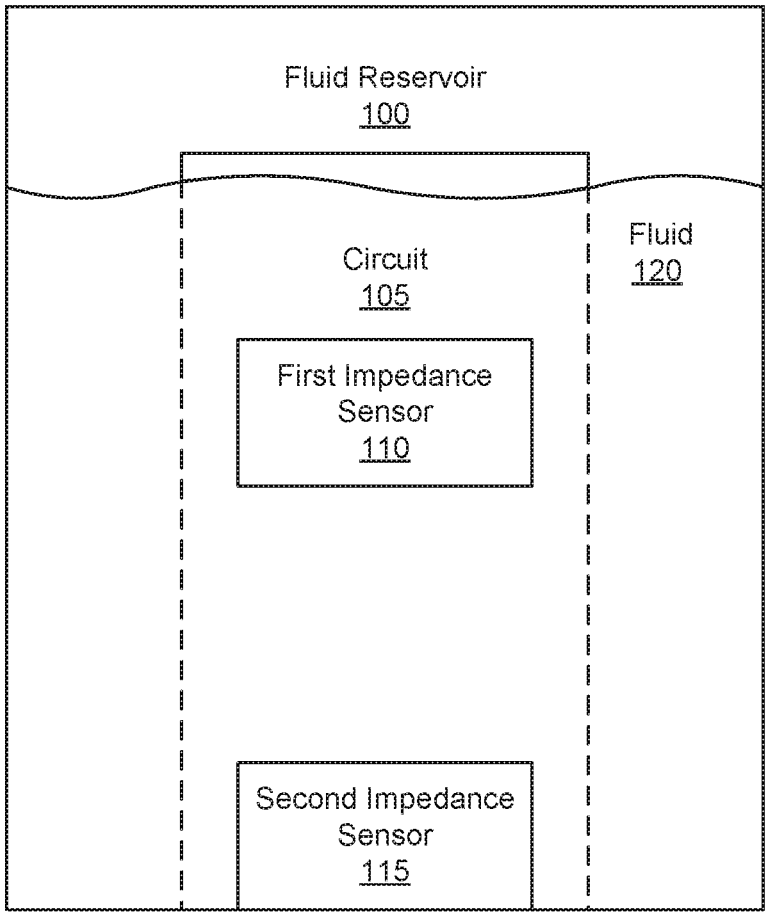
FIG. 1 is a block diagram of a fluid reservoir according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

The reservoirs fluidically coupled to, for example, a die wherein the die ejects the fluid from the die and/or moves the fluid within the die may hold a fluid to be used by the die. The fluids may include a particle within a fluid such as a printing fluid that includes color pigments suspended in a fluidic vehicle. In the example of printing fluids, over time, the color pigments in the fluidic vehicle located in the nozzle region may diffuse and settle within the reservoirs. The separation of these pigment particles from the fluidic vehicle may be referred to herein as pigment ink vehicle separation or pigment vehicle separation (PIVS), or may be generically referred to herein as particle vehicle separation (PVS).

PVS may occur after a period of time, for example, minutes or even seconds without being refreshed or stirred. Due to evaporation and other effects such as gravity and properties related to the fluid formulation, particles within the fluid may, over time, migrate out of a first portion of the reservoir and into lower portions of the reservoir. Consequently, this leaves fluid in a relatively higher portion of the reservoir without its particle constituent. Accordingly, those lower portions of the reservoir may contain fluid that has a relatively higher concentration of particles. If, in the case of a pigmented printing fluid of a printing device, the pigmented printing fluid is ejected from a nozzle in a PVS condition, a first number of ejected drops out of the nozzle may have an incorrect amount of pigment particles or colorant in it, and will affect the print quality of that part of the printed image. Stated another way, as a consequence of PVS for example, ejection of the printing fluid from the nozzle with an increased or decreased amount of color pigments onto the media results in a reduction of image quality. A resulting print on the media in a PVS situation may have a perceivable deficiency in correct colors and may look discolored or overcolored. In situations where an image is to be printed using a plurality of drops, the act of ejecting fluid from the fluidic die may not refresh the nozzles and the reservoir may provide a similarly high pigment concentration printing fluid to the nozzles. Additionally, at times, pigment ink vehicle separation may result in solidification of the printing fluid in the nozzle region. Particle interaction in a PVS scenario may cause a spectrum of responses based on characteristics of the particles and the environment in which the fluid exists, including, for example, the geometry of the particles and the design of the chambers within the fluidic die, among other characteristics. In this case, the respective nozzle region may prevent the ejection of printing fluid and reduce the lifespan of a corresponding fluid ejector.

Even though pigment printing fluids are used herein as an example to describe a fluid vehicle and particles where the fluid vehicle is used to carry or suspend a particle within the fluid vehicle, similar fluids including particles and fluid vehicles may be equally applicable. For example, some biological fluids such as blood may include particles suspended in a fluid vehicle. In the case of blood, blood includes bloods cells suspended in blood plasma. In this example, the blood cells may separate or diffuse where a higher concentration of blood cells exist in a first portion of the blood plasma relative to another portion of the blood plasma where there may exist a relatively lower concentration of blood cells. Where the blood is maintained in a reservoir, these blood cells may separate from the blood plasma and settle at a bottom portion of the reservoir.

Therefore, PVS may occur in a wide range of fluids that are moved within and/or ejected from a fluidic die. Detection of the separation of a particle from its fluid vehicle may allow for remedial measures to be taken to correct any particle concentration disparities within the fluid maintained in the reservoir. Thus, examples described herein provide a fluid reservoir that, via a number of impedance sensors, detects the particle concentration of the fluid held therein to determine if PVS has occurred. In an example, a remedial process may be initiated when a PVS has been detected.

The present specification describes a fluid reservoir that includes a circuit extending in the fluid reservoir to be at least partially in contact with fluid inside the fluid reservoir during use, at least a first impedance sensor and second impedance sensor coupled to the circuit, wherein the at least first and second impedance sensors are to output impedance values indicative of a degree of particle separation in the fluid.

The present specification also describes a fluid ejection device that includes a fluid ejection die and a fluid reservoir that includes a first impedance sensor and a second impedance sensor, and an evaluator module to evaluate sensed impedance values at the first impedance sensor and second impedance sensor.

The present specification further describes a method of determining pigment separation in a printing fluid that includes receiving a first sensed impedance value of the printing fluid from a first impedance sensor, receiving a second sensed impedance value of the printing fluid from a second impedance sensor, evaluating at least the first sensed impedance value and the second sensed impedance value against at least one threshold value to determine a concentration of particles in the printing fluid, and executing a remedial process based on the concentration of particles.

Turning now to the figures, FIG. 1 is a block diagram of a fluid reservoir (100) according to an example of the principles described herein. The fluid reservoir (100) may include a circuit (105) extending in the fluid reservoir (100) at least partially in contact with fluid (120) inside the fluid reservoir (100) during use. The circuit (105), in an example, may include a die. A die can refer to any block that includes a substrate on which functional elements can be formed. In some examples, the functional elements formed on the substrate of a die can include the circuit (105) described herein. In an example, the die is made of any number of layers of silicon and may facilitate an electrical coupling of, for example, the first impedance sensor (110) and second impedance sensor (115) with other electrical components associated with the reservoir as described herein.

The fluid (120) may be any type of fluid that includes any number of particles therein. Even though pigment printing fluids are used herein as an example to describe a fluid vehicle and particles where the fluid vehicle is used to carry or suspend a particle within the fluid vehicle, similar fluids including particles and fluid vehicles may be equally applicable. For example, some biological fluids may serve as the fluid (120) such as blood which may include blood cells suspended in a blood plasma. Thus, the fluid (120) may be used by the systems described herein in a number of different ways to fulfill a number of different purposes. In some examples, the fluid (120) may be moved within a fluidic die (not shown) fluidically coupled to the fluid reservoir (100). In some examples, the fluid (120) may be ejected from the fluidic die after receiving an amount of fluid form the fluid reservoir (100). In some examples, the fluid (120) is moved within the fluidic die after receiving an amount of fluid from the fluid reservoir (100). The movement and/or ejection of the fluid (120) from or within the fluidic die may be facilitated by a number of pumps and/or fluid actuators such as thermal resistive devices or piezoelectric devices.

The first impedance sensor (110) and second impedance sensor (115) may be any device that can sense an impedance value of the fluid (120). In an example, the first impedance sensor (110) and second impedance sensor (115) may be an electrode electrically coupled to a voltage or current source. The electrode may be a thin-film electrode formed on an interior surface of the fluid reservoir (100) within the circuit (105). In an example, a current may be applied to the electrode when a fluid particle concentration is to be detected, and a voltage may be measured. In an example, a voltage may be applied to the electrode when a fluid particle concentration is to be detected, and a current may be measured.

In the example where a fixed current is applied to the fluid (120) surrounding the first impedance sensor (110) and/or the second impedance sensor (115) a resulting voltage may be sensed. The sensed voltage may be used to determine an impedance of the fluid (120) surrounding the first impedance sensor (110) and/or the second impedance sensor (115) at that area within the fluid reservoir (100) at which the impedance sensors (110, 115) are located. Electrical impedance is a measure of the opposition that the circuit formed from the impedance sensors (110, 115) and the fluid (120) presents to a current when a voltage is applied to the impedance sensors (110, 115), and may be represented as follows:

$$Z = \frac{V}{I} \qquad \text{Eq. 1}$$

where Z is the impedance in ohms (Ω), V is the voltage applied to the impedance sensors (110, 115), and I is the current applied to the fluid (120) surrounding the impedance sensors (110, 115). In another example, the impedance may be complex in nature, such that there may be a capacitive element to the impedance where the fluid (120) may act partially like a capacitor. For complex impedances, the current applied to the impedance sensors (110, 115) may be applied for a particular period of time, and a resulting voltage may be measure at the end of that time. A measured capacitance in this example may change with the properties of the fluid (120): one such property of the fluid (120) being particle concentration.

The detected impedance (Z) is proportional or corresponds to a particle concentration in the fluid (120). Stated in another way, the impedance (Z) is proportional or corresponds to a dispersion level of the particles within the fluid vehicle of the fluid (120). In one example, if the impedance is relatively lower, this may indicate that a higher particle concentration exists within the fluid (120) in that area at which the particle concentration is detected. Conversely, if the impedance is relatively higher, this indicates that a lower particle concentration exists within the fluid in that area at which the particle concentration is detected. Lower particle concentration within a portion the fluid (120) may indicate that PVS has occurred, and that remedial measures may be taken to ensure that the particle concentration is made homogeneous throughout all the fluid within the fluid reservoir (100) or, in some examples, homogeneous based on an original or manufactured homogeneity of the fluid (120). In an example, the impedance value reaches at least one threshold value, this may indicate that the impedance sensors (110, 115) are actually not in contact with the fluid (120). In this case, either of the impedance values detected by either of the impedance sensors (110, 115) may be disregarded in determining whether and which remedial process should be conducted to render the fluid (120) homogenous again.

An acceptable homogeneity of the fluid (120) with regards to the particle concentration may be based on an original or manufactured homogeneity value. The output impedance values from each of the impedance sensors (110, 115) may be evaluated by, for example, a processing device communicatively coupled to the circuit (105). The processing device may execute an evaluation module that evaluates the detected impedance values against the original or manufactured homogeneity values. These homogeneity values, in an example, may be provided in a look-up table (LUT) that provides a level of homogeneity based on any detected impedance value from the impedance sensors (110, 115). In the example, shown in FIG. 1, the first impedance sensor (110) may detect or sense a different impedance value than that detected or sensed by the second impedance sensor (115). In an example, different impedance values sensed amongst the impedance sensors (110, 115) may indicate a lack of homogeneity in particle concentration with the fluid (120) maintained in the fluid reservoir (100). Thus, in an example, a comparison between impedance values sensed among each of the impedance sensors (110, 115) may be used to determine whether a remedial process should be conducted. In an example, each impedance value detected by each of the impedance sensors (110, 115) may be evaluated against those values in the LUT and remedial processes may be started based on whether a threshold particle concentration is not determined to exist.

The remedial processes may include any process, using any device, that renders the fluid (120) homogeneous again as to the concentration of particles therein. In an example, the remedial process may include stirring the fluid (120) within the fluid reservoir (100). This may be done by activating a stirring device within the fluid reservoir (100), activating a fluid actuator within the fluid reservoir (100), adjusting a servicing process associated with the fluid reservoir (100) and/or fluidic die such that the fluidic die spits or causes an outer surface of the fluidic die to be wiped, adjusting energies applied to the fluid actuators, among others. In an example, a remedial action may include presenting instructions to a user via, for example, a graphical user interface associated with a printing device that instruct a user to access the fluid reservoir (100) and shake the contents therein for a duration of time, and replace the fluid reservoir (100). In an example, the remedial action may include vibrating the reservoir. In this example and where the reservoir forms part of, for example, a scanning cartridge in a printing device, the vibration of the reservoir may be accomplished by rapidly passing the cartridge along the rails used to scan the cartridge.

In an example, the circuit (105) may further include a number of reference electrodes that may be associated with each of the impedance sensors (110, 115) that provide a reference voltage or ground for each impedance sensor (110, 115). In this example, the additional electrodes serve as a return path used to measure the impedance through the fluid (120) as current is applied to the fluid (120) by the impedance sensors (110, 115). In an example, each of the reference electrodes are electrically coupled so as to provide the same or similar reference voltages. In an example, instead of coupling the reference electrodes in parallel, a multiplexer may be used to multiplex a reference electrode with a respective impedance sensor (110, 115) such that an impedance signal is received from each reference electrode/impedance sensor (110, 115) pair.

In an example, any number of impedance sensors (110, 115) may be used. FIG. 1 shows two impedance sensors (110, 115) aligned vertically along the circuit (105): the first impedance sensor (110) placed higher in the fluid reservoir (100) than the second impedance sensor (115). However, additional impedance sensors (110, 115) may be used to detect the impedance value of the fluid (120) in order to determine the particle concentration of the fluid (120) anywhere within the fluid reservoir (100), This may allow for a relatively more refined determination as to the particle concentration even when, for example, the first impedance sensor (110) is no longer in contact with the fluid (120) in the fluid reservoir (100) due to depletion of the fluid (120).

In an example, the fluid reservoir (100) may include a fluid level sensor to detect the level of fluid within the fluid reservoir (100). The fluid level sensor may be used in connection with the impedance values sensed by the impedance sensors (110, 115) in order to determine which impedance values should and should not be considered. For example, the first impedance sensor (110) may, after some use, no longer be in physical contact with the fluid (120) in the fluid reservoir (100). Such an impedance sensed by the first impedance sensor (110) should not be used to determine the particle concentration of the fluid (120). By receiving input from the fluid level sensor that any one of the impedance sensors (110, 115) is out of the fluid (120), those impedance values may be disregarded.

In an example, each of the impedance values sensed by the impedance sensors (110, 115) may be compared to determine which, if any of the impedance sensors (110, 115) are defective. In this example, a sanity check may be initiated to determine if any of the sensed impedance values are not rational based on other sensed impedance values, By way of example, if five different impedance sensors (110, 115) are used with 4 sensors along a vertical depth of fluid (120) indicating a monotonic trend moving down the circuit (105), this alone may indicate PVS has occurred. If the fifth impedance sensor (110, 115) placed between the 4 other impedance sensors (110, 115) indicates a relatively higher or lower particle concentration beyond a threshold value, this may indicate an anomaly or defective impedance sensor (110, 115) and the sensed impedance from the fifth impedance sensor (110, 115) may be disregarded. Alternatively, in an example, instead of disregarding the sensed impedance value of the fifth impedance sensor (110, 115), the fifth impedance sensor (110, 115) may reinitiate an impedance measurement to validate that an anomalous measurement was valid and repeatable. After a number of iterations of repeating anomalous measurements, the sensed impedance from the fifth impedance sensor (110, 115) may then be disregarded.

Figure 2:
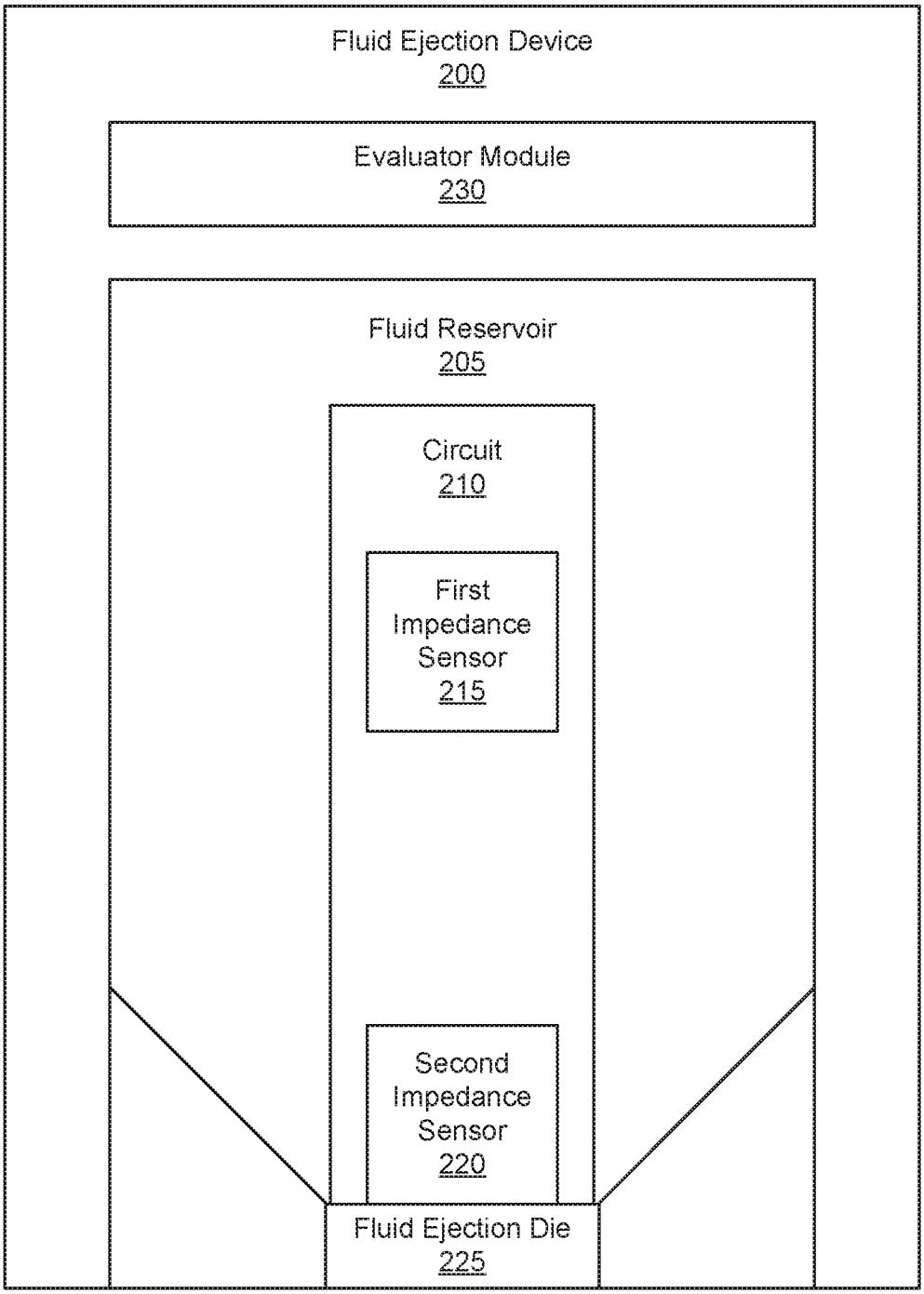
FIG. 2 is a block diagram of a fluid ejection device according to an example of the principles described herein.

FIG. 2 is a block diagram of a fluid ejection device (200) according to an example of the principles described herein. The fluid ejection device (200) may include a fluid reservoir (205), a circuit (210), and at least a first impedance sensor (215) and a second impedance sensor (220). The fluid reservoir (205), a circuit (210), and at least a first impedance sensor (215) and a second impedance sensor (220) may be similar to those described in connection with FIG. 1. The fluid ejection device (200) may further include a fluid ejection die (225) and an evaluator module (230).

The fluid ejection die (225) may be fluidically coupled to the fluid reservoir (205). In some examples, the fluid maintained in the fluid reservoir (205) may be ejected from the fluid ejection die (225). In some examples, the fluid is moved within the fluid ejection die (225). The movement and/or ejection of the fluid from or within the fluid ejection die (225) may be facilitated by a number of pumps and/or fluid actuators such as thermal resistive devices or piezoelectric devices.

The evaluator module (230) may be any computer usable program code, firmware, and/or hardware that evaluates sensed impedance values at the first impedance sensor and second impedance sensor. This evaluation conducted by the evaluator module (230) may include receiving the sensed impedance values from the first impedance sensor (215) and second impedance sensor (220) and evaluating those sensed impedance values against values maintained, for example, in a look-up table. The values may be particle concentration values that relate to specific impedance values sensed by the impedance sensors (215, 220). If the particle concentration values drop below a certain threshold value or rise above a certain threshold value, the remedial processes described herein may be enacted to render the fluid homogeneous.

The fluid ejection device (200) may further include a fluid level sensor in the reservoir similar to that presented in connection with FIG. 1. Again, the fluid level sensor may be used in connection with the impedance values sensed by the impedance sensors (110, 115) in order to determine which impedance values should and should not be considered.

Figure 3:
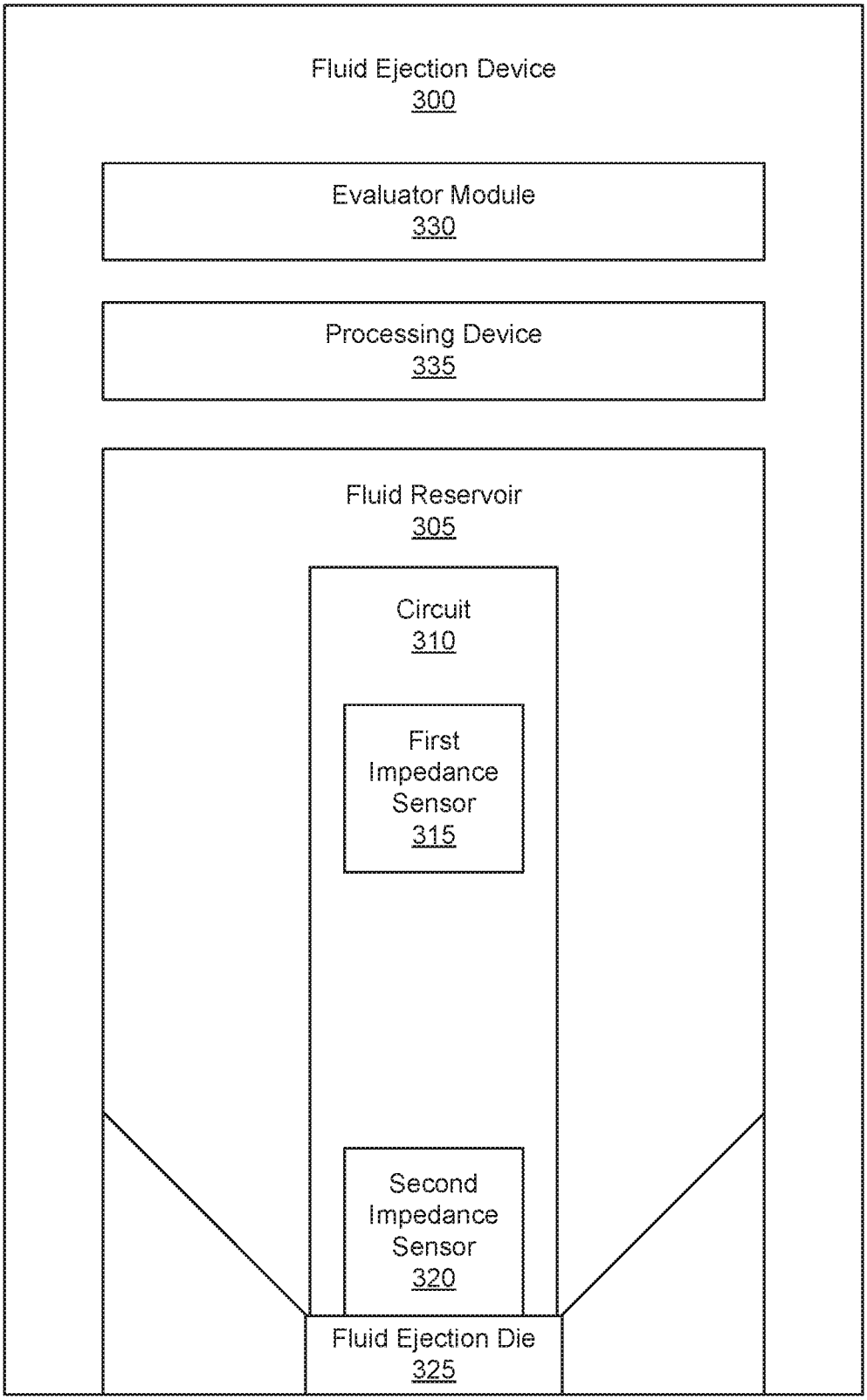
FIG. 3 is a block diagram of a fluid ejection device according to an example of the principles described herein.

FIG. 3 is a block diagram of a fluid ejection device (300) according to an example of the principles described herein. The fluid ejection device (300) may include a fluid reservoir (305), a circuit (310), at least a first impedance sensor (315) and a second impedance sensor (320), a fluid ejection die (325), and an evaluator module (330). The fluid reservoir (305), a circuit (310), at least a first impedance sensor (315) and a second impedance sensor (320), a fluid ejection die (325), and an evaluator module (330) may be similar to those described in connection with FIG. 2. The fluid ejection device (300) may further include a processor (335). The processor (335) may execute the evaluator module (330) as well as receive the impedance values sensed by the first impedance sensor (315) and second impedance sensor (320). In an example the fluid ejection device may be part of a fluid dispensing system such as a printing device. The printing device may include the processing device (335) and may be separate from the fluid ejection device (300).

Figure 4:
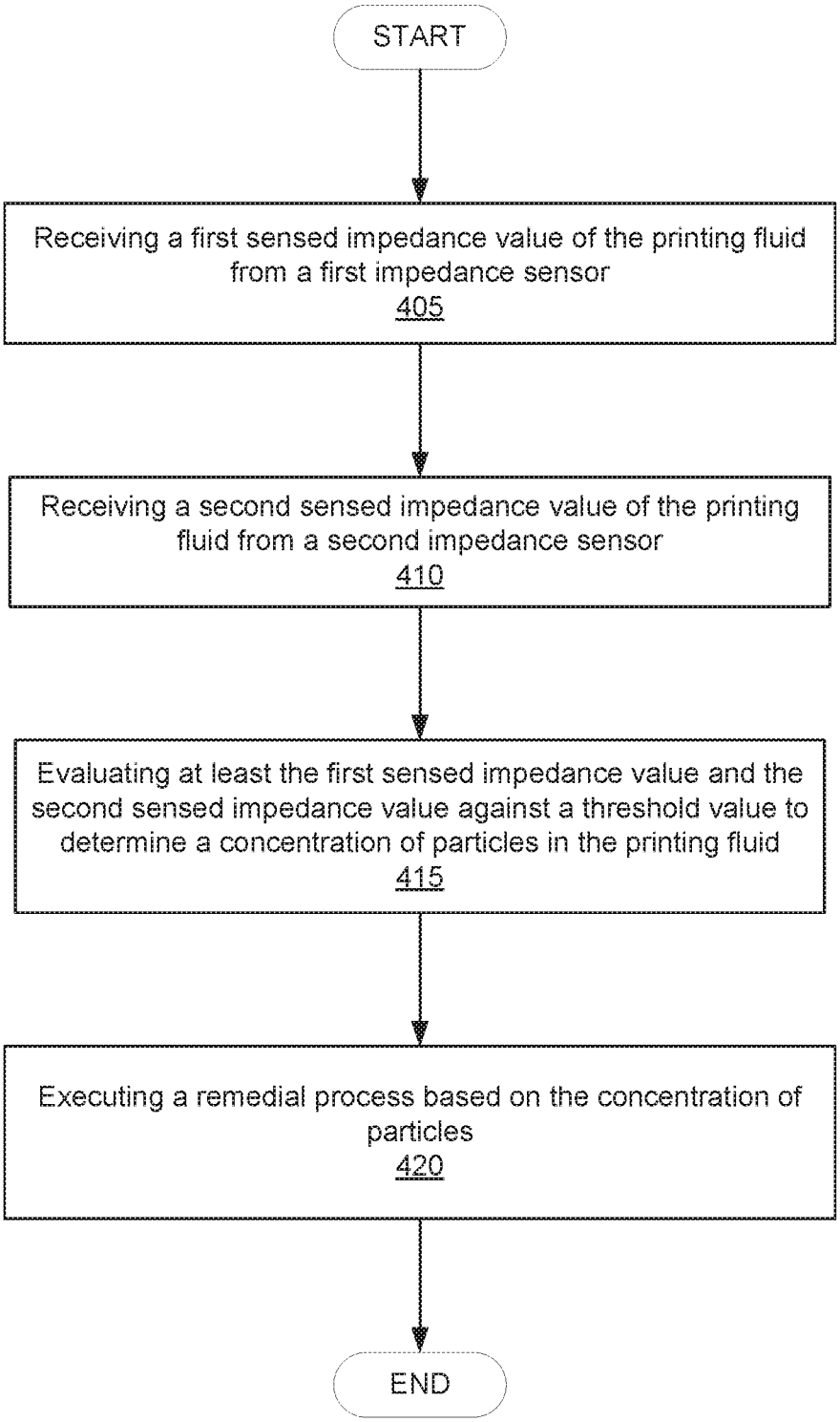
FIG. 4 is a flowchart showing a method of determining particle separation in a printing fluid according to an example of the principles described herein.

FIG. 4 is a flowchart showing a method (400) of determining particle separation in a printing fluid according to an example of the principles described herein. The method (400) may begin with receiving (405) a first sensed impedance value of the printing fluid from a first impedance sensor. Similarly, the method (400) may continue with receiving (410) a second sensed impedance value of the printing fluid from a second impedance sensor.

The method (400) may continue evaluating (415) at least the first sensed impedance value and the second sensed impedance value against at least one threshold value to determine a concentration of particles in the printing fluid. This may be done via the evaluator module (230) as described herein. In an example, each impedance values detected by each of the impedance sensors may be compared against a impedance threshold value specific to the impedance sensor.

The method may continue with executing a remedial process based on the concentration of particles. Again, the remedial process may include stirring the fluid (120) within the fluid reservoir (100). This may be done by activating a stirring device within the fluid reservoir (100), activating a fluid actuator within the fluid reservoir (100), adjusting a servicing process associated with the fluid reservoir (100) and/or fluidic die that spit or wipe the fluidic die, adjusting energies applied to the fluid actuators, among others. In an example, a remedial action may include presenting instructions to a user via, for example, a graphical user interface associated with a printing device that instruct a user to access the fluid reservoir (100) and shake the contents therein for a duration of time, and replace the fluid reservoir (100). Still further, a remedial action may include vibrating the reservoir as described herein.

Figure 5:
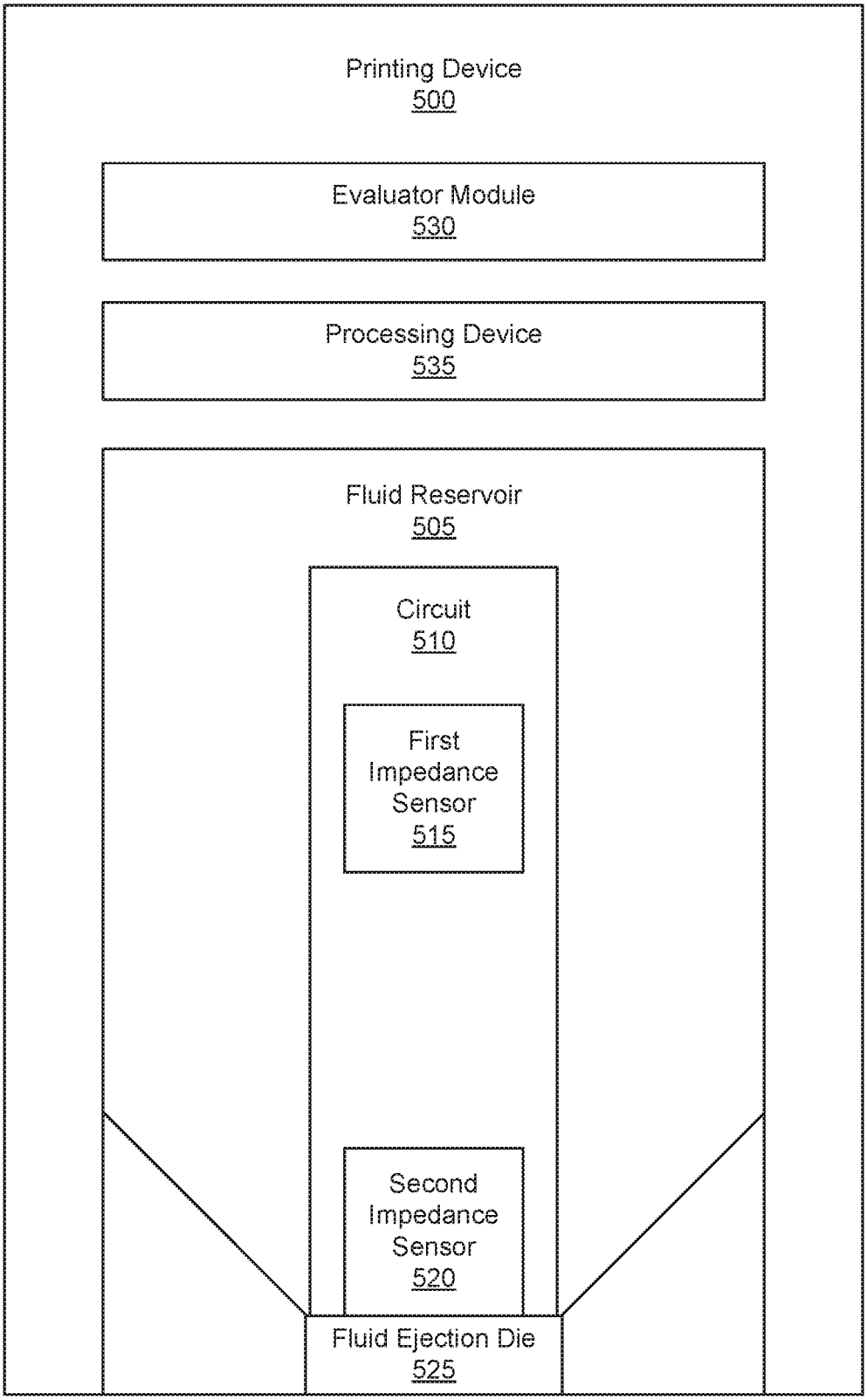
FIG. 5 is a block diagram of a printing device according to an example of the principles described herein.

FIG. 5 is a block diagram of a printing device (500) according to an example of the principles described herein. The printing device (500) may include a fluid reservoir (505) that includes a circuit (510) having a first impedance sensor (515) and second impedance sensor (520) and a fluid ejection die. In an example, the reservoir (505) and fluid ejection die (525) may be formed into a print cartridge that may be selectively removed from the printing device (500). In the example, shown in FIG. 5, the printing device (500) may include a processing device (535) to execute computer usable program code such as the evaluator module (530) as described herein.

Figure 6:
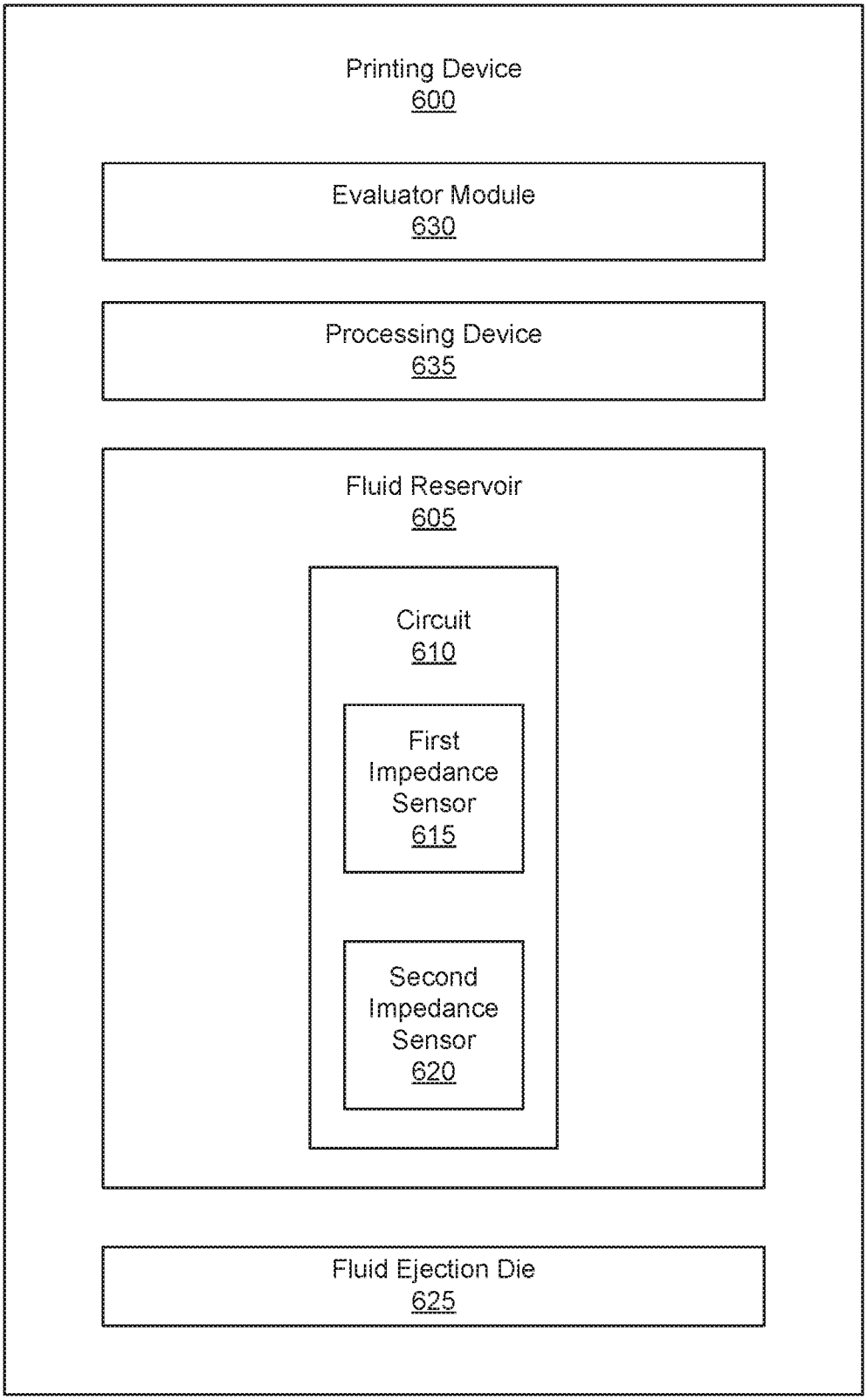
FIG. 6 is a block diagram of a printing device according to an example of the principles described herein.

FIG. 6 is a block diagram of a printing device (600) according to an example of the principles described herein. The printing device (600) may include a fluid reservoir (605) that includes a circuit (610) having a first impedance sensor (615) and second impedance sensor (620) and a fluid ejection die. In an example, the reservoir (605) may be separate physically from the fluid ejection die (625) but may still be in fluid communication with the fluid ejection die (625). In this example, the fluid reservoir may be selectively removed from the printing device (600) for replacement or remedial servicing as described herein. FIG. 6 further shows the printing device (600) including a processing device (635) to execute computer usable program code such as the evaluator module (630) as described herein.

Figure 7:
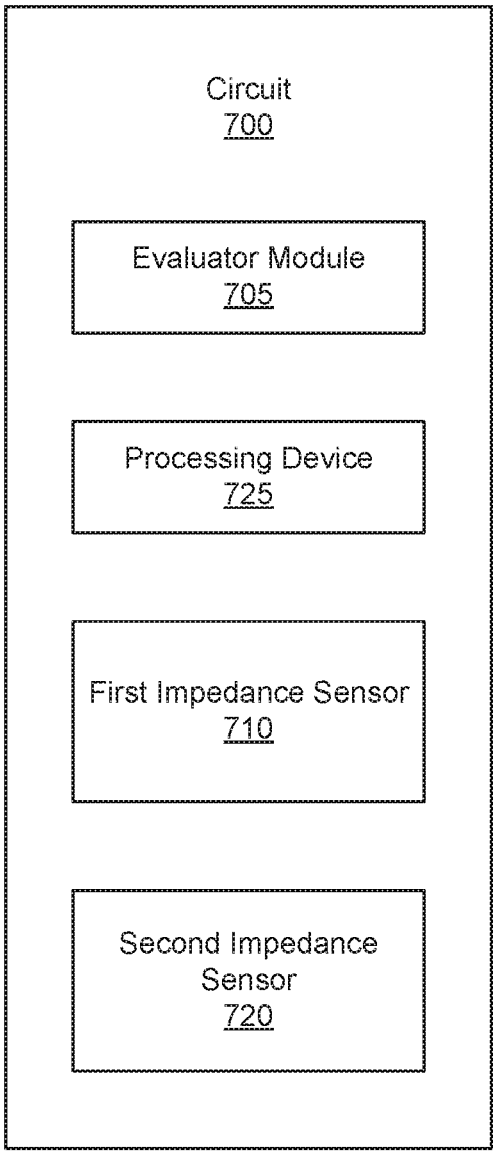
FIG. 7 is a block diagram of a circuit according to an example of the principles described herein.

FIG. 7 is a block diagram of a circuit (700) according to an example of the principles described herein. The circuit (700) may include an evaluator module (705), a first impedance sensor (710), a second impedance sensor (720), and a processing device (725). In an example, the circuit may be coupled to an interior surface of a fluid reservoir as described herein. In the example shown in FIG. 7, the circuit (700) may include its own processing device (725) used to execute computer usable program code such as that associated with the evaluator module (705). The processing device (720) may further receive sensed impedance values from the first impedance sensor (710) and second impedance sensor (720). As described herein, upon execution of the computer usable program associated with the evaluator module (705), the circuit (700) may determine a particle concentration of the fluid within a fluid reservoir. When the particle concentration of the fluid is above a certain threshold value at any one of the locations where the first impedance sensor (710) and the second impedance sensor (720) are located in the fluid reservoir, the processing device (720) may cause a signal to be sent indicating that at least one of the remedial actions is to be initiated. Similarly, when the particle concentration of the fluid is below at least one threshold value at any one of the locations where the first impedance sensor (710) and the second impedance sensor (720) are located in the fluid reservoir, the processing device (720) may cause a signal to be sent indicating that at least one of the remedial actions is to be initiated.

The specification and figures describe a fluid reservoir that includes a circuit to determine the particle concentration of a fluid within the fluid reservoir. In the example where the fluid reservoir holds an amount of printing fluid, the circuit may determine whether the particles within the printing fluid have settled out of their fluidic vehicle which may cause poor quality prints during use of the printing fluid. Similarly, in the example where the fluid is a blood sample, a disproportionate amount of blood cells may have settled within the blood plasma. If any portion of the blood sample were being used for analysis, variances in the concentration of blood cells within the blood sample may prevent an appropriate analysis of the sample. The circuitry described herein also allows for quick analysis of the fluid as the fluid reservoir is being used such that the real-time particle concentration of the fluid may be detected. When the particle concentration is above or below a threshold amount, remedial actions may be taken to maintain the pigment concentration at manufacturing or original standards. Additionally, the circuit may be integrated into the structure along with other devices in the fluid reservoir such as a fluid level sensor.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid reservoir, comprising:

a circuit extending in the fluid reservoir to be at least partially in contact with fluid inside the fluid reservoir during use;

at least a first impedance sensor and second impedance sensor coupled to the circuit;

wherein the at least first and second impedance sensors are to output impedance values indicative of a degree of particle separation in the fluid.

2. The fluid reservoir of claim 1, the circuit further comprising an evaluator module to evaluate the sensed degree of pigment separation in the fluid from each of the at least first and second impedance sensors.

3. The fluid reservoir of claim 2, wherein the evaluator module comprises a comparator to compare the degree of particle separation detected to a threshold and to provide results of the comparison to a processing device associated with the fluid reservoir and wherein the processing device is to initiate a fluid stirring process in the fluid container in response to the degree of particle separation detected being above the threshold.

4. The fluid reservoir of claim 2, the circuit comprising at least a third impedance sensor the third sensor placed intermittent between the first and second sensor, wherein the evaluator module is to:

evaluate the sensed degree of pigment separation in the fluid also from the third sensor, and disregard a sensed impedance representative of no contact with the fluid when at least one of the first, second, and third impedance sensors are not in contact with the fluid.

5. The fluid reservoir of claim 2, wherein the evaluator module the evaluator module comprises a look-up table (LUT) that provides a level of homogeneity as to particle dispersion within a fluid in the reservoir as a function of the sensed impedance values from the first and second impedance sensors.

6. The fluid reservoir of claim 1, further comprising a fluid level sensor within the fluid reservoir.

7. The fluid reservoir of claim 6, the circuit comprising an evaluator module to:

evaluate the sensed degree of pigment separation in the fluid from each of the at least first and second impedance sensors; and use the sensed fluid level to calibrate at least one of the first and second impedance sensors.

8. The fluid reservoir of claim 1, wherein each of the first and second impedance sensors comprise a thin-film resistor that is exposed to the fluid.

9. The fluid reservoir of claim 1, wherein the circuit further comprises a processor to receive output impedance values from the at least first and second impedance sensors indicative of a degree of particle separation in the fluid, the processor further to, from the impedance values, determine a degree of particle settling within the fluid and selectively execute a remedial action if the determined degree of particle settling exceeds a threshold.

10. The fluid reservoir of claim 9, further comprising a fluid level sensor within the fluid reservoir, the processor to use an output of the fluid level sensor to determine when any of the impedance sensors is not in contact with the fluid and to then disregard a sensed impedance from the impedance sensor not in contact with the fluid.

11. A fluid ejection device, comprising:

a fluid ejection die; and a fluid reservoir comprising a circuit comprising a first impedance sensor and a second impedance sensor; and an evaluator module to evaluate sensed impedance values at the first impedance sensor and second impedance sensor, the evaluator module having a look-up table (LUT) that provides a level of homogeneity as to particle dispersion within a fluid in the reservoir as a function of the sensed impedance values from the first and second impedance sensors.

12. The fluid ejection device of claim 11, further comprising a fluid level sensor to provide a sensed level of fluid within the fluid reservoir to a processor associated with the fluid reservoir.

13. The fluid ejection device of claim 12, wherein the sensed level of fluid within the reservoir is used to calibrate at least the first impedance sensor and a second impedance sensor.

14. The fluid ejection device of the 8, wherein the sensed impedance value from the first impedance sensor and the sensed impedance value from the second impedance sensor are evaluated against values maintained in a look-up table.

15. The fluid ejection device of claim 14, wherein the at least first and second impedance sensors measure the fluid level within the fluid reservoir.

16. A method of determining particle separation in a printing fluid, comprising:

receiving a first sensed impedance value of the printing fluid from a first impedance sensor;

receiving a second sensed impedance value of the printing fluid from a second impedance sensor;

evaluating at least the first sensed impedance value and the second sensed impedance value against at least one threshold value to determine a concentration of particles in the printing fluid; and executing a remedial process based on the concentration of particles.

17. The method of claim 16, comprising receiving a third sensed impedance value of the printing fluid from a third impedance sensor and wherein evaluating the first sensed impedance value, second sensed impedance value, and third sensed impedance value to the at least one threshold value provides a gradient value of particle separation within the printing fluid.

18. The method of claim 17, wherein the gradient value is evaluated against values maintained in a look-up table in order to determine the particle separation among any of the first, second, and third impedance sensors.

19. The method of claim 16, wherein the remedial process comprises vibrating or instructing a user to shake a reservoir containing the printing fluid to redistribute the particles throughout the fluid.

20. The method of claim 16, wherein the remedial process comprises passing reservoir containing the printing fluid incorporated into a cartridge along rails used to scan the cartridge so as to agitate the fluid so as to redistribute the particles throughout the fluid.

* * * * *